United States Patent [19]

de Bayser et al.

[11] 4,319,208

[45] Mar. 9, 1982

[54] MICROWAVE FILTER INCORPORATING DIELECTRIC RESONATORS

[75] Inventors: Pierre de Bayser; Pierre Fraise; Yves Le Nohaic, all of Paris, France

[73] Assignee: Thomson-CSF, Paris, France

[21] Appl. No.: 58,605

[22] Filed: Jul. 18, 1979

[30] Foreign Application Priority Data

Jul. 21, 1978 [FR] France ..... 78 21711

[51] Int. Cl.[3] ..... H01Q 2/03

[52] U.S. Cl. ..... 333/204

[58] Field of Search ..... 333/202, 204, 205, 208, 333/211, 227, 230

[56] References Cited

U.S. PATENT DOCUMENTS

| | | | |
|---|---|---|---|
| 3,688,225 | 8/1972 | Cohn | 333/204 |
| 3,713,051 | 1/1973 | Kell | 333/202 |
| 3,740,675 | 6/1973 | Moore et al. | 333/202 |
| 3,938,064 | 2/1976 | Bryan et al. | 333/204 |
| 4,184,130 | 1/1980 | Nishikawa et al. | 333/227 |

*Primary Examiner*—Eli Lieberman

*Attorney, Agent, or Firm*—Roland Plottel

[57] ABSTRACT

The filter is of the type comprising a waveguide and an electromagnetically coupled dielectric resonator. A slot constituting the waveguide is cut in a metal plate forming part of the filter. The resonator is separated from the metal plate by a dielectric support.

4 Claims, 4 Drawing Figures

MICROWAVE FILTER INCORPORATING DIELECTRIC RESONATORS

This invention relates to a microwave filter comprising a metal plate, a waveguide and one or a number of dielectric resonators, said resonators being electromagnetically coupled to the waveguide.

Filters of this type are already known and fall into two categories: band-pass filters and band-stop filters. A filter of this known type is constituted by a plate of dielectric material, one side of which is covered by a metal plate which performs the function of a ground plane and the other side of which serves as a support for a microstrip and for one or a number of dielectric resonators which are electromagnetically coupled to the waveguide. In some cases, the thickness of these known filters provides excessive and the reasons which explain this objectionable thickness are twofold. The first reason lies in the fact that it is very difficult, especially in the case of band-pass filters, to achieve correct coupling between the microstrip and the resonator or resonators when the permittivity of the dielectric plate is of high value; it is therefore necessary to employ a dielectric having a permittivity in the vicinity of 1, thus making it necessary to employ a dielectric plate of substantial size. The second reason lies in the fact that the microstrip and the resonator or resonators can be placed only on one and the same side of the dielectric plate since the metal plate covers the other side of the dielectric plate. In point of fact, the coupling to be provided between the waveguide and the resonator or resonators entails the need to ensure that each resonator is placed above the waveguide with respect to the dielectric plate and at a certain distance from said waveguide. This distance to be maintained between the waveguide and each resonator (for example by means of pastilles of dielectric material) is added to the thickness of the metal plate, of the dielectric plate and of the resonators.

The aim of the present invention is primarily to reduce the thickness of dielectric-resonator filters while facilitating the construction of filters of this type.

This result is achieved by modifying the design concept of filters both in regard to the nature of their waveguides and in regard to the respective positions of their different elements.

According to the invention, provision is made for a microwave filter comprising a metal plate, a slotted waveguide constituted by a slot formed in the metal plate and n dielectric resonators (n being a positive integer) which are electromagnetically coupled to the waveguide.

A more complete understanding of the present invention will be gained from the following description and from the accompanying drawings, wherein.

Corresponding elements in the different figures are designated by the same references.

Figure 1:
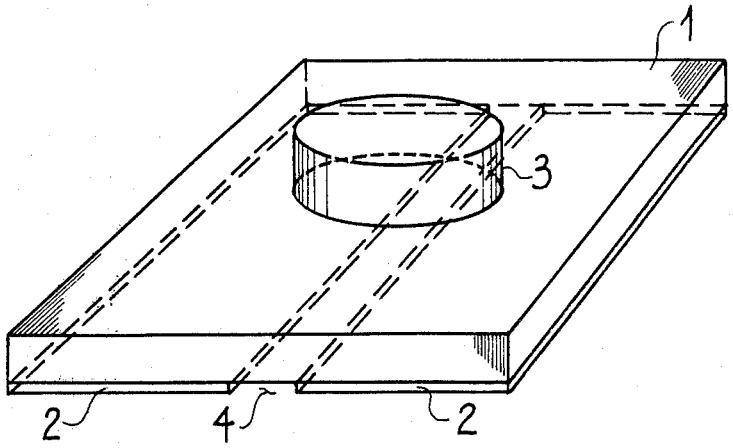
FIGS. 1 to 3 illustrate filters in accordance with the invention.

FIG. 1 shows a band-stop filter in accordance with the invention. This filter comprises a support plate 1 of Teflon glass having a permittivity of 2.6. One face of said support plate is covered by gold-coating with a thin metal plate 2 which consitutes a ground plane for the filter. A slotted waveguide 4 is formed in the metal plate 2 by partial non-metallization of the support plate 1. A dielectric resonator 3 is bonded to the other face of the support plate. By reason of the fact that a slotted waveguide has electric and magnetic fields which diffract to a greater extent outside the waveguide than those of a microstrip having equivalent dimensions, the construction of this filter does not give rise to as many problems as the corresponding strip filter. Moreover, since the slotted waveguide radiates on both sides of the metal plate and since both the slotted waveguide and the metal plate are located on the same side of the dielectric plate, it has proved possible to place the resonator on the other side of the dielectric plate with respect to the slotted waveguide. It does not therefore serve any useful purpose to place a spacing device between the slotted guide and the resonator since the dielectric plate performs this function.

In FIG. 1 as also in FIGS. 2 and 3 which will be described hereinafter, the dimensions of certain elements have been purposely exaggerated for the sake of enhanced clarity of the drawings. The actual dimensions of the filter are:

- width of the metal plate and of the dielectric plate: 40 mm
- length of the metal plate, of the dielectric plate and of the slotted waveguide: 50 mm
- thickness of the metal plate and depth of the slotted waveguide: 100 microns
- thickness of the dielectric plate: 1.27 mm
- width of the slotted waveguide: 300 microns
- diameter of the resonator: 8 mm
- thickness of the resonator: 5 mm The filter of FIG. 1 was constructed with a plate of Telfon glass having a permittivity of 2.6 and a resonator having a base of barium titanate and a permittivity of 40. The characteristics of this filter are as follows:

- center frequency: 5500 MHz
- stop-band width at 3 db: 90 MHz

By way of comparison, a filter comprising a dielectric resonator and microstrip having equivalent dimensions and designed to operate with the same frequencies has the following characteristics:

- center frequency: 5500 MHz
- stop-band width at 3 dB: 18 MHz

Figure 2:
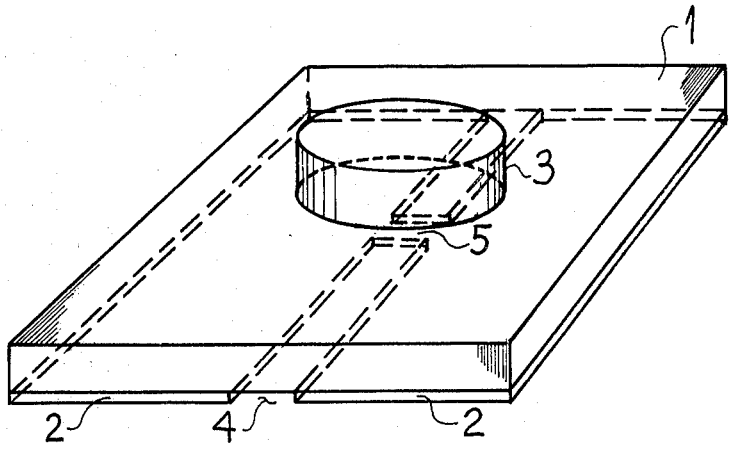

FIG. 2 shows a band-pass filter in accordance with the invention. The constructional design of this filter differs from the filter of FIG. 1 only in that the slotted waveguide 4 is interrupted directly opposite to the resonator over a distance of 10 mm by a metallized portion 5 which forms a short-circuit.

The characteristics of the filter shown in FIG. 2 are as follows:

- center frequency: 5500 mHz
- stop-band width at 3 dB: 100 MHz

Figure 3:
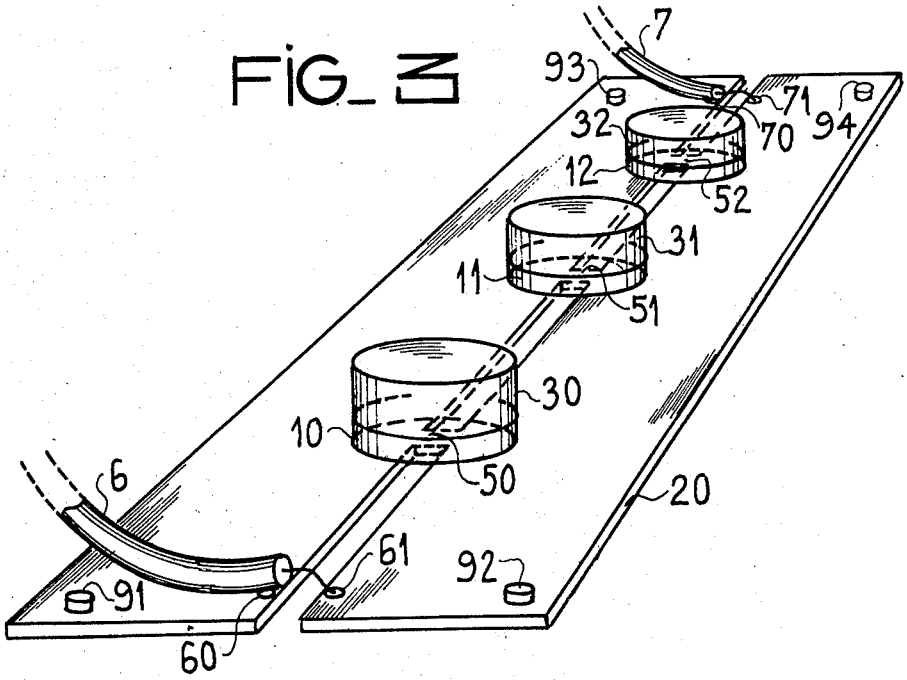

FIG. 3 illustrates a band-pass filter in accordance with the invention. This filter comprises three resonators 30, 31, 32, a metal plate 20 of copper having a thickness of 0.3 mm. A slotted waveguide 40 is cut in said plate and divided into four sections by short-circuits 50, 51, 52. The thickness of the metal plate of the filter shown in FIG. 3 is considerably greater than that of the filters shown in FIGS. 1 and 2. In contradistinction to the filters of FIGS. 1 and 2 in which mechanical rigidity was provided by the dielectric plate, rigidity must in fact be provided in this case by the metal plate since said filter does not have a dielectric plate. The resonators 30, 31, 32 are separated from the metal plate by dielectric wafers 10, 11, 12 and are placed in the vicinity of the short-circuits 50, 51, 52.

A coaxial conductor 6 placed in the vicinity of one end of the slotted waveguide 40 serves as a first access to the filter. To this end, its outer conductor terminates on one edge of the slotted guide and is soldered to this latter (spot connection 60) whilst its inner conductor is extended above the slotted guide and soldered to the other edge of said guide (spot connection 61). A second coaxial conductor 7 placed in the vicinity of the other end of the slotted guide 40 with respect to the coaxial conductor 6 serves as a second access to the filter. To this end, said second conductor is connected by means of its outer and inner conductors respectively at two points located on each side of the slotted guide (spot connections 70 and 71).

At −3 dB, the pass-band of the filter shown in FIG. 3 increases from 5460 to 5540 MHz.

Figure 4:
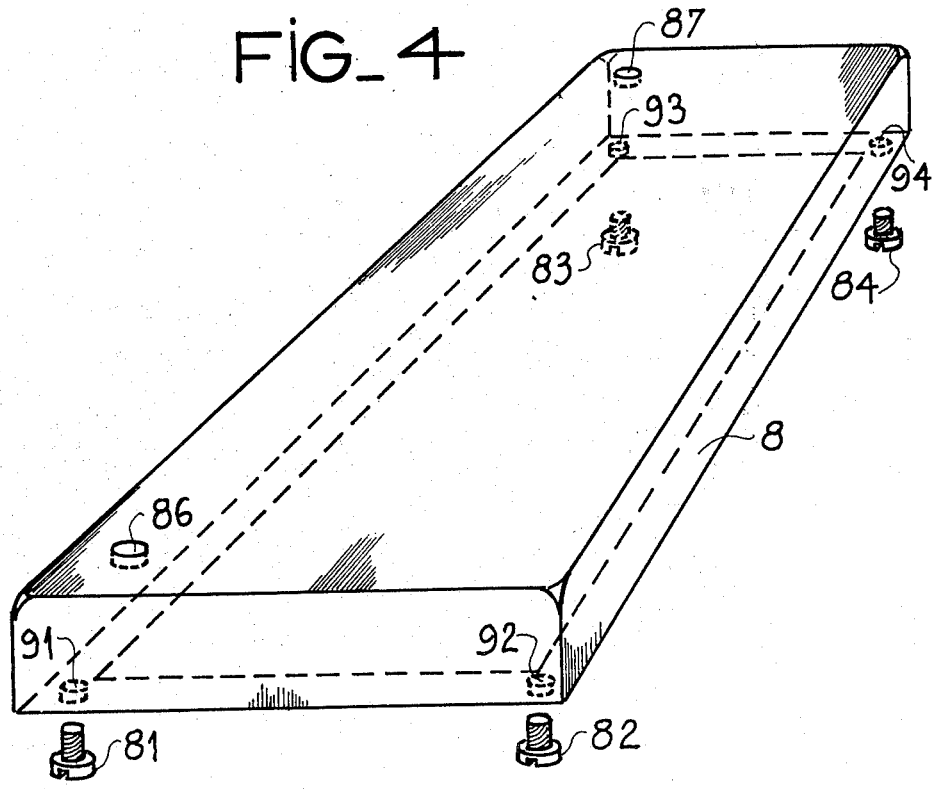
FIG. 4 illustrates a cover for the filter shown in FIG. 3.

The filter of FIG. 3 is also provided with a cover 8 as illustrated in FIG. 4. Said cover is constructed of metal and has the same overall dimensions as the metal plate 20 on which said cover is fixed by means of screws 81 to 84. Said screws traverse the metal plate 20 through holes 91 to 94 formed for this purpose (as shown in FIG. 3). The filter cover 8 is also pierced by two holes 86 and 87 through which cables 6 and 7 are intended to pass (as shown in FIG. 3).

The present invention is not limited to the three examples hereinabove described. From this it accordingly follows, for example, that the filter proper will be placed in most cases within a metal enclosure in order to prevent any radiation towards the exterior.

What is claimed is:

1. A microwave filter comprising a metal plate, a slotted waveguide and n dielectric resonators (n being a positive integer) which are electromagnetically coupled to the slotted waveguide, wherein said waveguide is constituted by a slot which is cut in said metal plate, and in which the metal plate is a rigid plate, wherein the slot has been formed by cutting in said metal plate, said filter being provided with n wafers of dielectric material placed between the metal plate and the n resonators respectively.

2. A microwave filter of the bandstop type comprising a metal plate, a slotted waveguide and n dielectric resonators (n being a positive integer) which are electromagnetically coupled to the slotted waveguide, wherein said waveguide is constituted by a slot which is cut in said metal plate, wherein said filter comprises n short-circuits for dividing the slot into n+1 sections and wherein n resonators are respectively placed in the vicinity of the n short-circuits.

3. A microwave filter according to claim 2, wherein said filter comprises a dielectric plate having a first face on which is deposited a metallic coating constituting said metal plate and another face on which are fixed the n resonators and wherein the slot has been formed by an interruption in said metallic coating.

4. A microwave filter according to claim 2, in which the metal plate is a rigid plate, wherein the slot has been formed by cutting in said metal plate, said filter being provided with n wafers of dielectric material placed between the metal plate and the n resonators respectively.

* * * * *